US006767250B2

(12) United States Patent
Casses et al.

(10) Patent No.: US 6,767,250 B2
(45) Date of Patent: Jul. 27, 2004

(54) SEALED CONNECTOR WITH A JOINT COMPRESSION DEVICE

(75) Inventors: Claude Casses, Clevilliers (FR); Jean-Francois Clerc, Paris (FR); Gérard Mulot, Nogent le Roi (FR); Frédéric Regnier, Raizeux (FR)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/252,966

(22) Filed: Sep. 23, 2002

(65) Prior Publication Data

US 2003/0068925 A1 Apr. 10, 2003

(30) Foreign Application Priority Data

Sep. 24, 2001 (FR) ..... 01 12558

(51) Int. Cl.[7] ..... H01R 13/40
(52) U.S. Cl. ..... 439/587; 439/157
(58) Field of Search ..... 439/587–589, 439/157

(56) References Cited

U.S. PATENT DOCUMENTS 5,299,949 A 4/1994 Fortin
6,174,201 B1 * 1/2001 Murakami et al. ..... 439/587
6,231,388 B1 * 5/2001 Murakami et al. ..... 439/587

FOREIGN PATENT DOCUMENTS

| | | |
|---|---|---|
| DE | 8714016 | 1/1988 |
| DE | 19742697 A1 | 4/1999 |
| EP | 0273999 A2 | 7/1988 |
| EP | 0292118 A1 | 11/1988 |
| GB | 2323976 | 10/1998 |
| WO | WO 98/37597 | 8/1998 |

* cited by examiner

*Primary Examiner*—Gary Paumen
*Assistant Examiner*—James R. Harvey
(74) *Attorney, Agent, or Firm*—Perman & Green LLP

(57) ABSTRACT

A connector comprising a first module 1, comprising a housing body 100, an contact-carrying insert 101, a rear guidance and cable support grid 107, a joint 105 provided with wire passages arranged between the contact-carrying insert and the rear grid, the insert being retained in the housing body and able to move between an forward position of relaxation of the joint and a backward position of pressure of the joint against the rear grid.

10 Claims, 3 Drawing Sheets

SEALED CONNECTOR WITH A JOINT COMPRESSION DEVICE

BACKGROUND OF THE INVENTION

1. Field of the Invention

The invention relates to a sealed electrical connector provided with a joint compression device. Such connectors are more particularly used for connecting an electrical harness comprising a large number of channels to equipment such as an automotive computer which controls braking assistance and anti-wheel lock devices. Because of the large number of channels to be connected, such connectors comprise a large number of contacts and to provide the rear seal of the connector at the plug, they are provided with a joint pierced for the passage of contacts and cables connected to the said contacts. Moreover, in order to render the mating between the connector plugs and receptacles easier, a means of mating assistance is generally provided.

2. Brief Description of Related Developments

Connector devices comprising a mating assistance device are known.

For example, document DE-U-87 14 016 concerns a plug-receptacle connector, in which the plug is provided with a lever rotating about a plug axis, provided with a toothed part and arms connected by a manoeuvring segment, the toothed part being destined to mesh with the supplementary teeth of the receptacle in such a way as to make possible the mating and unmating of the plug and receptacle by means of manoeuvring the lever.

Document EP 0 273 999 A2 adopts the principle of a toothed lever, but this is arranged on the receptacle and interlocked to the receptacle by an axis of rotation and drags a stirrup provided with a reception and dragging ramp of studs, arranged on the plug.

An example of the connector with a pierced joint for the passage of contacts is described in, for example, the documents U.S. Pat. No. 5,299,949 and WO98/37597. The rear joint described in these documents is retained between a body of the connector and a retention element integral with the body of the connector.

SUMMARY OF THE INVENTION

The present invention has the object of providing a connector comprising an improved rear seal device.

In order to accomplish this, the invention relates to mainly to a connector comprising a housing body, a contact-carrying insert, a rear grid guidance and cable retention grid, a joint provided with passages for wires which are arranged between the contact-carrying insert and the rear grid, the insert being retained in the body of the housing and able to move between a forward position of joint relaxation and a backward position of compression of the joint against the rear grid.

The contact-carrying insert and the body of the housing can moreover comprise a first means of stopping in a forward position of the insert.

The means of stopping can consist of an external ribbed shoulder of the insert and an internal ribbed shoulder of the housing body.

In a preferred form of embodiment, the insert consists of a main body provided with plug receptacle for the reception of contacts, associated with element carrying terminal locking blades. The joint is arranged leaning with its lower face against the terminal locking blade carrying element and with its lateral faces against a rear skirt of the principal body, the upper face of the joint being in contact with the lower face of the rear grid.

In a particular form of embodiment, the fist module can be provided with a means of mating and locking assistance, with a supplementary module comprising a means of dragging the first module by transfer in a direction parallel to a mating axis of the first and second modules. Under the action of these means of dragging, the insert comes to press by its forward face against a front face provided with contact terminals of the supplementary module and is pushed into a backward position.

The means of mating assistance can, in particular, comprise a dragging device of a stud, integral with one of the modules, in a direction opposite to the direction of the mating of the two modules, when the latter are in the process of being mated.

Advantageously, the supplementary module comprises a peripheral skirt surrounding the said front face, the housing body comprising a peripheral wall whose lower edge supports an upper edge of the peripheral skirt.

Still according to the invention, the first module is provided with a cover provided with a means of locking on the housing body, the cover comprising tabs supported on the rear guidance grid.

The means manoeuvre and locking can consists of a lever provided with at least one manoeuvre arm and at least one stud, the lever being provided with at least one stud reception aperture, the stud constituting an axis of rotation of the lever, the lever comprising a means of dragging the modules in the direction of mating and unmating.

The means of dragging can, in particular, consist of a toothed pinion on the lever and a rack bar on the first module.

BRIEF DESCRIPTION OF THE DRAWINGS

The invention will be better understood by reading the description which follows and a non-limitative embodiment example referring to the diagrams, where.

DETAILED DESCRIPTION OF THE PREFERRED EMBODIMENT

Figure 3:
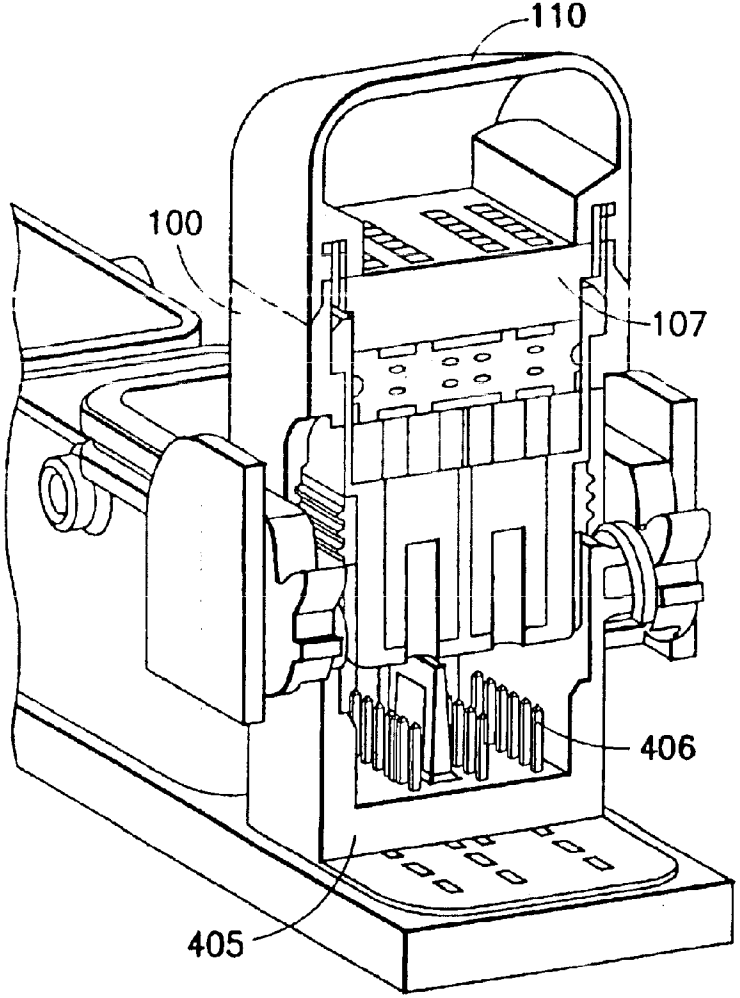
FIG. 3 is a perspective view with a section of a complete connector in pre-mating position.
Figure 1:
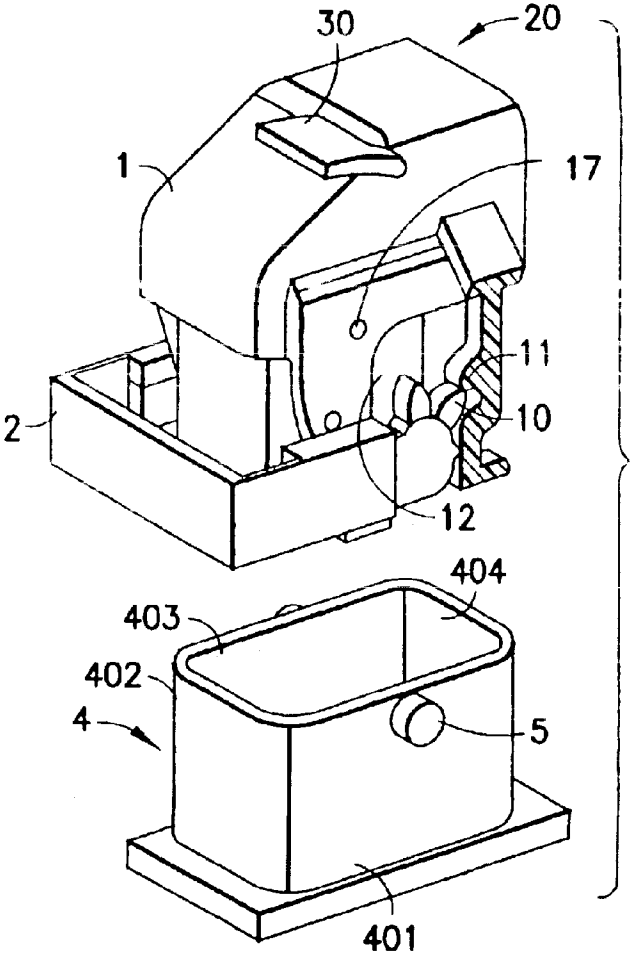
FIG. 1 is a perspective view of a connector to which the invention is applicable.

As can be seen FIG. 1 and according to the example under consideration, a connector, which may comprise elements of the invention, comprises a first module 1 and a second module 4. These connector modules have a supplementary engagement profile and contain supplementary contact elements and/or optical plugs. The contacts of the first module are, for example, linked to cables emerging from a rear part 10 of the second module, which may be connected to a printed circuit or to cable connections.

Figure 2:
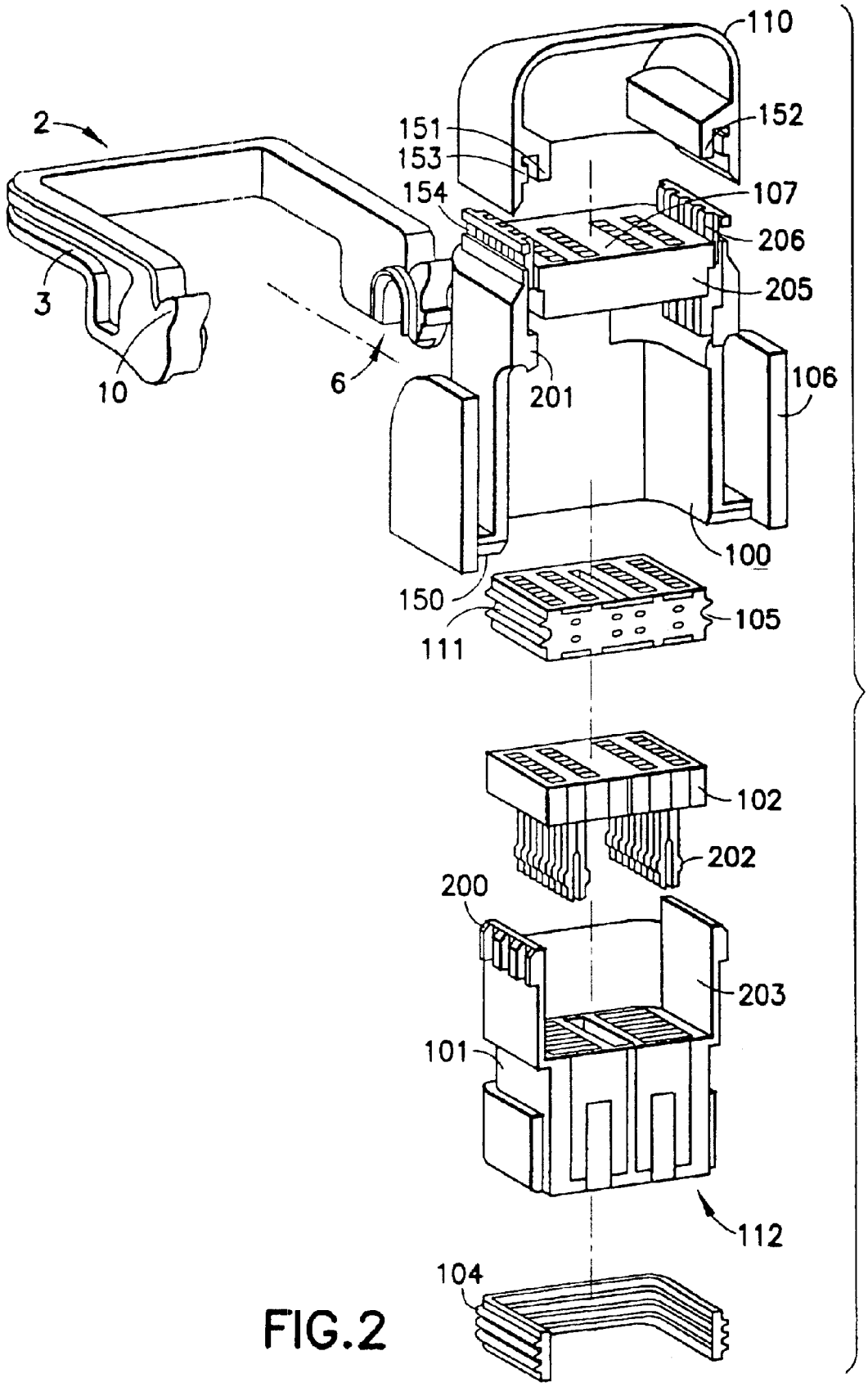
FIG. 2 is an exploded view with a section of elements of a module of a connector according to the invention.

A module 1 according to the invention is described FIG. 2, not assembled and in section. The module comprises a housing body consisting of an envelope 100 containing a contact carrier 101, a primary contact locking device 102, an inter-facial joint 105 pierced for the passage of contacts provided with their cables. The housing body comprises a rear grid 107 and a protective cover 110 for cable exits. This cover comprises a means of locking on the housing body of the grooved rail type (153, 154) supported on the rear grid.

On the periphery of the contact carrier 101 is arranged a ring joint 104 destined to create a seal between the front part of module 1 and module 4 after mating. The different elements constituting the module are assembled in the envelope 100 by the front, that is to say, the front of the mating of module 1 with a supplementary module 4 and the contacts are then inserted through a rear wall of the rear grid 107.

Figure 4:
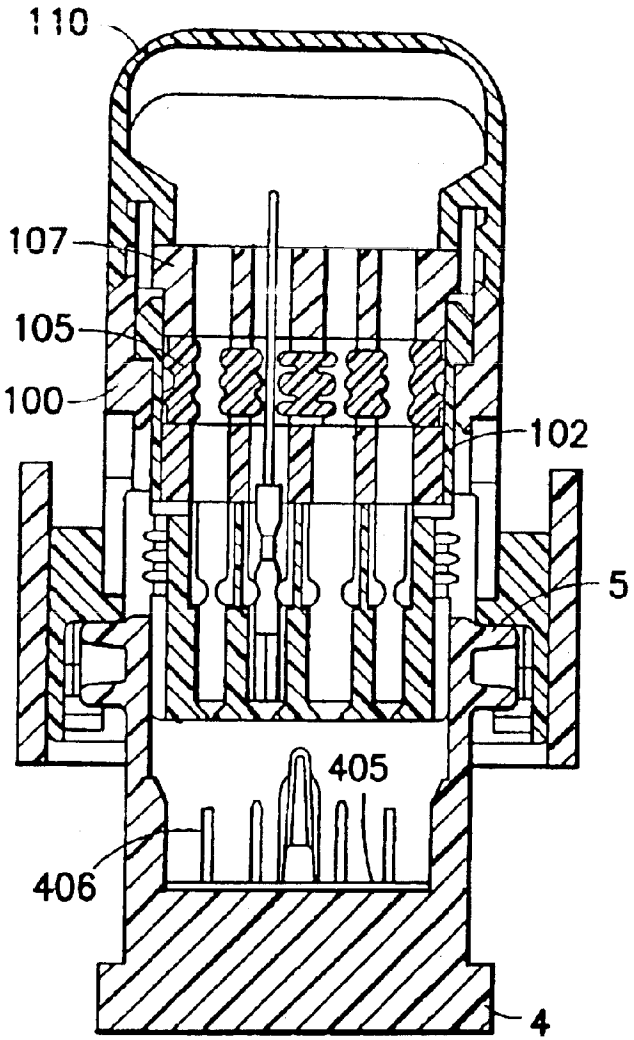
FIG. 4 is a plan view in section of contact reception apertures of a connector according to the invention in pre-mating position.

As can be seen, more particularly, FIG. 4, the insert 101 is provided with apertures for the reception of female contacts, an example of which is shown. These apertures, which open backward in a seating surrounded by the walls of the rear skirt 203 and forward via the passage openings of contact pins of the second module.

The seating or tub contains a grid element 102 of terminal locking blades 202 for the retention of contacts, The terminal locking blades are elastic blades provided with a locking lug in a contact window.

The joint 105 is arranged supported by its lower face on the terminal locking blade carrying element. The said joint is an inter-facial joint or grommet, provided with openings for the passage of contacts and cables linked to the said contacts. It comprises on its lateral faces lips 111, which press against the internal walls of the skirt 103 of the insert.

As can be seen FIG. 2, the insert is provided on two of its opposite sides on the rear part of the skirt 203, with a ribbed retention shoulder 200 in the housing body and turned towards the exterior of the skirt 203. The insert is inserted by the front (side of mating with a supplementary module) of the housing body. The housing body comprises an internal shoulder 201 also ribbed in such a way as to allow the ribbing of the shoulder of the insert to pass through. The insert is then moved sideways parallel to its sides which comprise the ribbing, in such a way that it is opposite the ribbing of the housing body.

Once it is in position, the insert can have a movement from the front backwards, the insert being able to move between the forward position of relaxation of the joint for which the ribs 200 are in contact with the ribs of the internal shoulder 101 and a rearward position of joint compression against the rear grid. The shoulders 100 and 101 form the first means of stopping in a forward position of the insert.

The envelope 100 of the housing body is closed on a rear face by a rear grid 109, which comprises an interior area 105 of a section suitable to enter into the rear skirt of the insert in order to be supported on the joint. This rear grid 107 is preferably integral with the housing body.

The rear grid 107 is connected to external walls of the envelope by columns 206, offset laterally with reference to the ribbing 201 and the ribbing 200 of the insert which makes possible a slide bar and a guidance of the ribbing 200 during their movement between the forward position and the rearward position of the insert.

The second module 4 comprises a face 405 perpendicular to the direction of mating of the modules and provided with a contacts terminal 406. This face 405 is surrounded by walls 401, 402, 403 and 404 forming a profile which is supplementary to the profile of insert 10.

Figure 5:
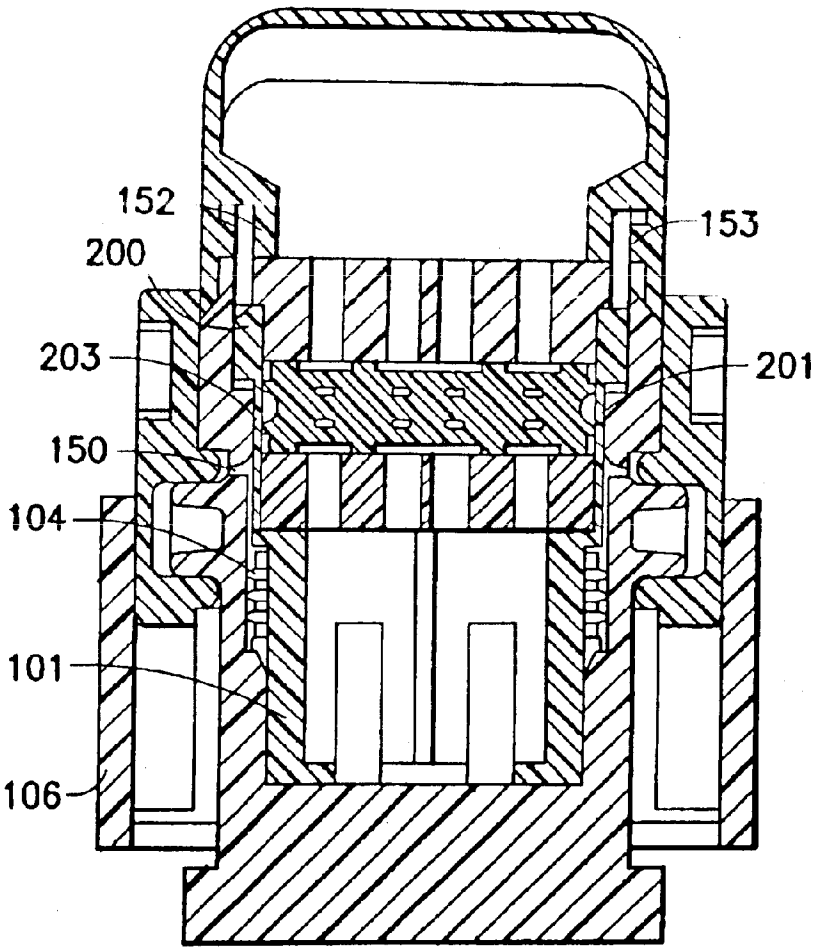
FIG. 5 is a section view of the connector from FIG. 3, in a mated position according to a plane bordering the apertures.

During the mating of connectors, which is schematically represented in Fig. 4 in pre-mated position and in FIG. 5 in mated position, the insert 101 descends between the walls 401 to 404. At the end of the mating, the lower face 112 of the insert comes into contact with the face 405 of the supplementary module. During the locking of the modules, the insert retreats under the pressure of the face 405 and axially compresses the joint 105 in the mating direction, which brings about the compression of the peripheral lips 111 against the walls of the skirt 203 and the compression of the passages of cables on cables, thus providing an improved seal.

A locking device, which is particularly suitable for the invention will now be described.

The first module 1 carries a rotating lever 2 which makes it possible to implement a mating of the modules and in the example is shown as a double lever, arranged to straddle the first module 1, comprising two manoeuvring arms 3 connected by a central strap. These arms comprise at their free end an actuating part provided with a means making possible engagement with the second module and the dragging of the first module towards the second module. Each arm of the lever is in a seating comprising walls 106 protecting an actuating device, which will be described below.

An actuating device comprises an actuating part in the form of a disc, whose at least one peripheral sector comprises a toothed pinion 10. The disc comprises in its centre and on its face opposite the first module, an aperture 6, the actuating part of the lever is supported in a slide bar 12 of the first module 1, this slide bar making possible a relative movement of the lever 2 and the first module 1 in a direction parallel to the mating axis of the modules and retaining the lever in a plane perpendicular to that direction. The lever is guided into this slide bar and is able to turn.

The slide bar comprises two pillars parallel to the direction of mating of the modules. One of the pillars comprises a smooth profile, against which the disc can be supported whilst the other post comprises a rack bar 11, destined to be engaged by the teeth of the pinion 10 carried by the disc.

The lever is introduced by pressure, the arms of the lever elastically moving the walls 106 until the shrouds have been introduced into the slides bars located on each side of the envelope 100. Once the lever has been inserted into the slide bar, a rotation of the lever is converted into a longitudinal movement of the lever in the slide bar, following the engagement of the teeth of the pinion in the rack bar 11. This system constitutes the supplementary means of dragging the first module in a direction parallel to a mating axis of the first and second module.

The lever is first inserted into the slide bar as far as a pre-engagement position of the teeth with the rack bar 11. In this position, the lever has an angular orientation such that the opening at the end of the aperture 6 is positioned opposite stud 5 of the second module 4, when the first module is presented in the position of pre-insertion into the second module. By passing the first module into the second module, the stud enters the aperture 6.

At that moment, it is possible to turn the lever, the stud 5 constituting an axis of rotation of the lever. The rotation of the lever takes place on a fixed axis of the second module, the teeth of the pinion resting on the teeth of the rack bar, which forces the first module to be inserted into the second module, the lever only being subjected to a rotational movement with respect to the second module and so entering into an arc of a circle with respect to the second module.

The connector so constructed provides a very good seal at the cable passages and can receive cables of various cross-sections

What is claimed is:

1. A connector comprising a first module comprising a housing body, a contact carrier, a rear guidance and cable support grid, a joint provided with passages for wires arranged between the contact carrier and the rear grid, wherein the contact carrier is retained in the housing body and is able to move between a forward relaxed position of the joint and a rearward axially compressed position of the joint against the rear grid.

2. A connector according to claim 1, wherein the contact carrier and the housing body comprise a means of stopping the contact carrier in a forward position.

3. A connector according to claim 2, wherein the means of stopping comprise an external ribbed shoulder of the contact carrier and an internal ribbed shoulder of the body.

4. A connector comprising:

a first module comprising a housing body;

a contact carrier;

a rear guidance and cable support grid; and a joint provided with passages for wires arranged between the contact carrier and the rear grid, wherein the contact carrier is retained in the housing body and is able to move between a forward relaxed position of the joint and a rearward compressed position of the joint against the rear grid, wherein the contact carrier includes a principal body provided with a contact reception aperture and a terminal locking blade carrying element, wherein the joint is arranged to be supported by its lower face against the terminal locking blade carrying element and by its lateral faces against a rear skirt of the principal body, the upper face of the joint being in contact with the lower face of the rear grid.

5. A connector comprising:

a first module comprising a housing body;

a contact carrier;

a rear guidance and cable support grid; and a joint provided with passages for wires arranged between the contact carrier and the rear grid, wherein the contact carrier is retained in the housing body and is able to move between a forward relaxed position of the joint and a rearward compressed position of the joint against the rear grid, wherein the first module includes mating and locking assistance elements with a supplementary module including a means of dragging of the first module by transfer in a direction parallel to a mating axis of the first and supplementary module, and wherein under the action of the means of dragging, the contact carrier comes to press with its forward face against a front face provided with contact terminations of the supplementary module and is pushed into a backward position.

6. A connector according to claim 5, wherein the means of dragging comprise a dragging device of a stud integral with one of the modules in an opposite direction of mating of the two modules.

7. A connector according to claim 5, wherein the supplementary module comprises a peripheral skirt surrounding said front face, the housing body comprising a peripheral wall whose lower edge supports an upper edge of the peripheral skirt.

8. A connector comprising:

a first module comprising a housing body;

a contact carrier;

a rear guidance and cable support grid;

a joint provided with passages for wires arranged between the contact carrier and the rear grid, wherein the contact carrier is retained in the housing body and is able to move between a forward relaxed position of the joint and a rearward compressed position of the joint against the rear grid; and a cover provided with means of locking on the housing body, said cover comprising tabs supported on the rear grid.

9. A connector according to claim 5, wherein the means of dragging comprise a lever provided with at least one manoeuvring arm, at least one stud, the lever being provided with at least one stud reception aperture, the aperture comprising a stud introduction segment and a stud stopping segment, the stud stopping segment defining together with the stud of the second module, an axis of rotation of the lever.

10. A connector according to claim 9, wherein the means of dragging comprise a toothed pinion on the lever and a rack bar on the first module.

* * * * *